US008561583B2

(12) United States Patent
Butterfield

(10) Patent No.: US 8,561,583 B2
(45) Date of Patent: Oct. 22, 2013

(54) PHASER WITH OIL PRESSURE ASSIST

(75) Inventor: Roger P. Butterfield, Trumansburg, NY (US)

(73) Assignee: BorgWarner Inc., Auburn Hills, MI (US)

( * ) Notice: Subject to any disclaimer, the term of this patent is extended or adjusted under 35 U.S.C. 154(b) by 2 days.

(21) Appl. No.: 13/519,900

(22) PCT Filed: Dec. 20, 2010

(86) PCT No.: PCT/US2010/061206

§ 371 (c)(1),
(2), (4) Date: Jun. 29, 2012

(87) PCT Pub. No.: WO2011/081993

PCT Pub. Date: Jul. 7, 2011

(65) Prior Publication Data

US 2012/0285406 A1 Nov. 15, 2012

Related U.S. Application Data

(60) Provisional application No. 61/291,992, filed on Jan. 4, 2010.

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | | |
|---|---|---|---|---|
| 5,724,929 | A | 3/1998 | Mikame et al. | |
| 5,797,361 | A | 8/1998 | Mikame et al. | |
| 6,276,321 | B1 | 8/2001 | Lichti et al. | |
| 6,662,769 | B2 | 12/2003 | Eguchi et al. | |
| 6,997,150 | B2 | 2/2006 | Simpson | |
| 7,255,077 | B2 | 8/2007 | Simpson et al. | |
| 7,568,458 | B2 * | 8/2009 | Roth et al. | 123/90.17 |

FOREIGN PATENT DOCUMENTS

| | | | |
|---|---|---|---|
| JP | 2007332956 | A | 12/2007 |
| JP | 2008184952 | A | 8/2008 |
| JP | 2009215965 | A | 9/2009 |

OTHER PUBLICATIONS

International Search Report and Written Opinion; PCT/US2010/061206; Mailed Aug. 5, 2011; 8 pages.

* cited by examiner

*Primary Examiner* — Ching Chang
(74) *Attorney, Agent, or Firm* — Brown & Michaels, PC

(57) ABSTRACT

A variable cam timing phaser for adjusting phase between a first shaft and a second shaft using oil pressure from an oil pressure source including a housing assembly and a rotor assembly together defining a plurality of segments. The segments include at least one operating segment including an advance chamber and a retard chamber, the advance chamber and the retard chamber being oppositely switchable between at least a source of oil pressure and a drain, the vane being movable by oil pressure from the oil source applied to either the advance chamber or the retard chamber with the other of the advance chamber and the retard chamber being coupled to the drain and at least one assist segment including an assist chamber and a vent chamber, the vent chamber being vented to atmosphere; such that oil supplied to the assist chamber assists the motion of the vane in a direction.

6 Claims, 2 Drawing Sheets

PHASER WITH OIL PRESSURE ASSIST

REFERENCE TO RELATED APPLICATIONS

This application claims one or more inventions which were disclosed in Provisional Application No. 61/291,992 filed Jan. 4, 2010, entitled "OPA VCT PHASER WITH OIL PRESSURE BIAS". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing. More particularly, the invention pertains to an oil pressure actuated variable cam timing phaser with oil pressure assist.

2. Description of Related Art

Apart from the cam torque actuated (CTA) variable camshaft timing (VCT) systems, the majority of hydraulic VCT systems operate under two principles—oil pressure actuation (OPA) or torsional assist (TA). In the oil pressure actuated VCT phaser, one or more operating segments 30 each include a vane 4 defining the operating segments 30 into first working chambers 2 and second working chambers 3 in fluid communication with an oil control valve (OCV) 9. In the OPA VCT phaser, the OCV directs engine oil pressure to the first working chamber 2 while simultaneously venting the second opposing working chamber 3 defined by the housing 1, the rotor 5, and the vane 4. This creates a pressure differential across one or more of the vanes 4 to hydraulically push the VCT phaser in one direction or the other. Neutralizing or moving the OCV 9 to a null position in which the OCV 9 blocks fluid flow into and out of the first and second working chambers puts equal pressure on opposite sides of the vane 9 and holds the phaser in position. If the phaser is moving in a direction such that valves will open or close sooner, the phaser is said to be advancing and if the phaser is moving in a direction such that valves will open or close later, the phaser is said to be retarding.

Conventional phasers have three, four, or five operating segments 30. Within each of the operating segments is a vane 4 separating the chamber 17 formed between the housing 1 and the rotor 5 into first working chambers 2 and second opposing working chambers 3, commonly referred to as advance chambers and retard chambers. In conventional phasers, supply oil pressure is provided to each side of all of the vanes 4, designated V1 V2, V3, V4.

Referring to FIG. 1, the housing assembly 1 of the phaser has an outer circumference 7 for accepting drive force. The rotor assembly 5 is connected to the camshaft and is coaxially located within the housing assembly 1. The rotor assembly 5 has a vane(s) 4 separating chamber(s) 17 formed between the housing assembly 1 and the rotor assembly 5 into an advance chambers 2, designated A1, A2, A3, A4 and a retard chambers 3, designated R1, R2, R3, R4. The vanes 4 are capable of rotation to shift the relative angular position of the housing assembly 1 and the rotor assembly 5.

An oil control valve 9 is in fluid communication with all of the advance chambers 2 and the retard chambers 3 through advance passages 12 and retard passages 13. The oil control valve 9 controls the flow fluid from supply pump 18 to all of the advance chambers 2 and retard chambers 3 and from the advance chambers 2 and retard chambers 3 to exhaust 19. The oil control valve 9 may be biased in a first direction by a spring 40 and a second direction by an actuator 42.

If the phaser were to be moving toward an advance position, supply oil pressure 18 would be provided to all of the advance chambers 2, designated A1, A2, A3, A4 of the phaser e.g. all three, four or any number of the advance chambers present in the phaser, and any oil pressure in the retard chambers 3, designated R1, R2, R3, R4 e.g. all three, four or any number of the retard chambers present in the phaser, would all be exhausted or vented 19.

Additionally, if the phaser were to moving towards a retard position, supply oil pressure 18 would be provided to all of the retard chambers 3 of the phaser, designated R1, R2, R3, R4 e.g. all three, four or any number of the retard chambers present in the phaser, and any oil pressure in the advance chambers 2, designated A1, A2, A3, A4 e.g. all three, four or any number of the advance chambers present in the phaser, would be exhausted or vented 19.

Additionally, the phaser may be held in a null position in which the supply oil pressure 18 to advance chambers 2 and the retard chambers 3 is blocked and oil within the chambers is prevented from exhausting.

The torsional assist (TA) systems operates under a similar principle as the OPA systems, with the exception that it has one or more check valves to prevent the VCT phaser from moving in a direction opposite than being commanded, should it incur an opposing force such as torque.

In some applications of oil pressure actuated phasers and torsional assist phasers in engines, a bias towards the advance position is necessary. The bias is usually achieved with a bias spring or set of bias springs. The bias springs may be present within the advance or retard chambers themselves or between the between the housing and the rotor to bias the phaser towards an advance position.

SUMMARY OF THE INVENTION

A variable cam timing phaser for adjusting phase between a first shaft and a second shaft using oil pressure from an oil pressure source including a housing assembly and a rotor assembly together defining a plurality of segments. The segments include at least one operating segment comprising an advance chamber and a retard chamber, the advance chamber and the retard chamber being oppositely switchable between at least a source of oil pressure and a drain, the vane being movable by oil pressure from the oil source applied to either the advance chamber or the retard chamber with the other of the advance chamber and the retard chamber being coupled to the drain, the moving of the vane acting to shift the relative angular phase of the rotor assembly and the housing; and at least one assist segment comprising an assist chamber and a vent chamber, the vent chamber being vented to atmosphere; such that oil supplied to the assist chamber assists the motion of the vane in a direction.

DETAILED DESCRIPTION OF THE INVENTION

Figure 1:
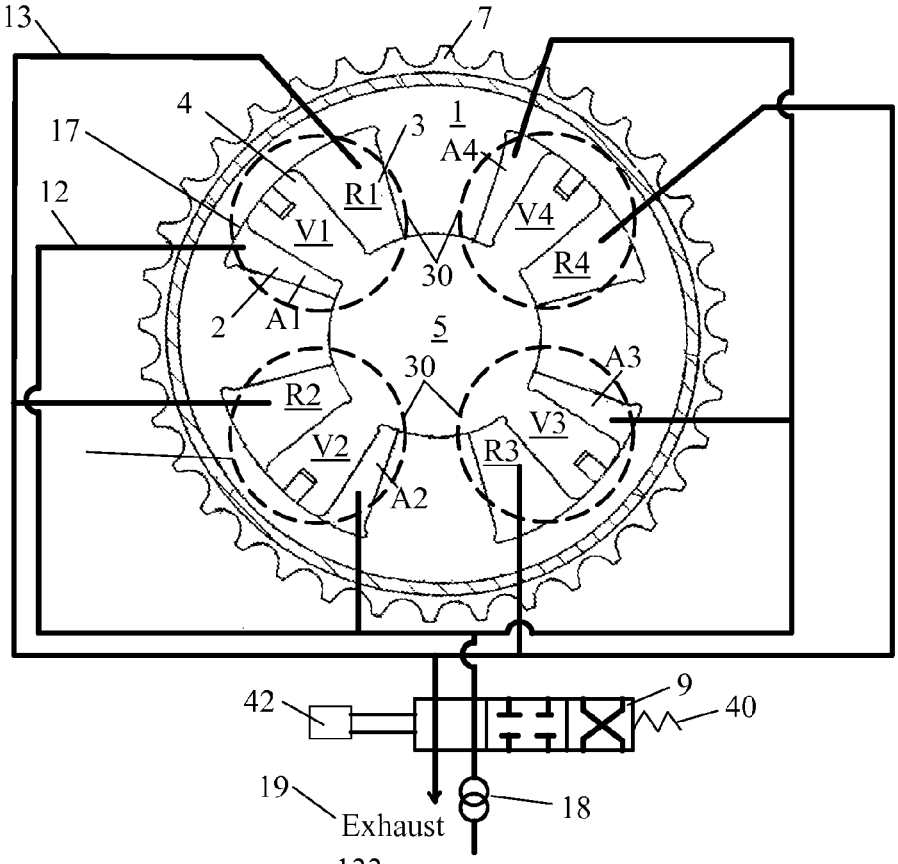
Fig. 1 Prior Art
FIG. 1 shows a conventional oil pressure actuated phaser.

Internal combustion engines have employed various mechanisms to vary the angle between the camshaft and the crankshaft for improved engine performance or reduced emissions. The majority of these variable camshaft timing (VCT) mechanisms use "vane phasers" on the engine camshaft (or camshafts, in a multiple-camshaft engine). In most cases, the phasers have a rotor 105 with one or more vanes 104 mounted to the end of the camshaft (not shown), surrounded by a housing assembly 101 with the vane chambers 117 into which the vanes 104 are received. It is possible to have the vanes 104 mounted to the housing assembly 101, and the chambers in the rotor assembly 105, as well. The housing's outer circumference 107 forms the sprocket, pulley or gear accepting drive force through a chain, belt, or gears, usually from the crankshaft, or possible from another camshaft in a multiple-cam engine. End plates (not shown) are present on either side of the phaser.

Figure 2:
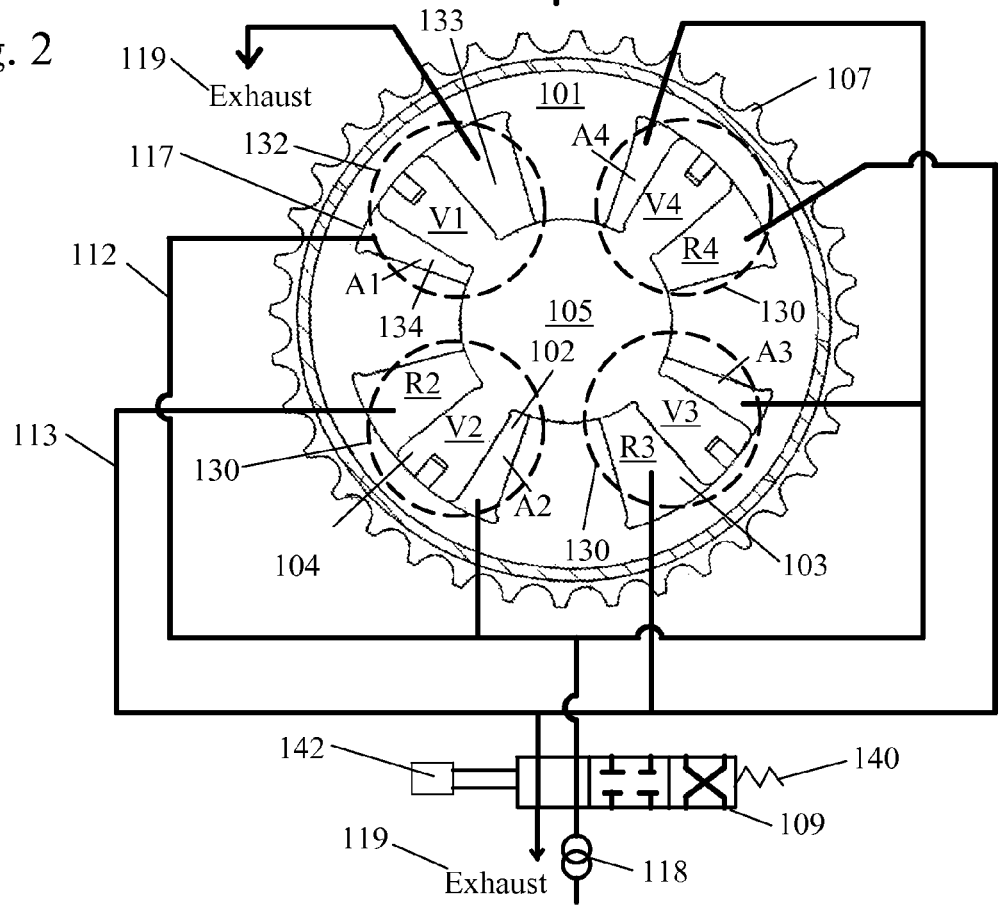
FIG. 2 shows a schematic of a phaser of a first embodiment of the present invention.

Referring to FIG. 2, the housing assembly 101 of the phaser has an outer circumference 107 for accepting drive force. The rotor assembly 105 is connected to the camshaft (not shown) and is coaxially located within the housing assembly 100. The phaser has at least one assist segment 132 and one or more operating segments 130. In one embodiment, the phaser preferably has a greater number of operating segments 130 than assist segments 132.

The operating segments 130 are each defined by the chamber 117 formed between the housing assembly 101 and the rotor assembly 105 and separated into advance fluid chambers 102, designated as A2, A3, A4 and retard fluid chambers 103 designated as R2, R3, R4 by a vane 104 designated V2, V2, V4. The one or more vanes 104, designated V2, V3, V4 are capable of rotation to bi-directionally shift the relative angular position of the housing assembly 101 and the rotor assembly 105 within the operating segments 130 of the phaser.

The assist segment 132 is defined by the chamber 117 formed between the housing assembly 101 and the rotor assembly 105 and a vane 104 separating the chamber into a fluid assist chamber 134 in fluid communication with an oil pressure supply 118 through an oil control valve and a vent chamber 133 vented to atmosphere or exhaust 119 at all times. The vane 104, designated V1 is capable of rotation to unidirectionally shift the relative angular position of the housing assembly 101 and the rotor assembly 105 and therefore, the assist segment 132 assists in shifting the relative angular position of the housing assembly relative to the rotor assembly in one direction only. While the figures only show the assist toward advancing the phaser, a person skilled in the art may apply the invention such that the assist would be toward retarding the phaser.

A pump 118 supplies supply oil pressure through the oil control valve 109 in fluid communication with the advance chambers 102, the retard chambers 103, and assist chamber 134 through advance passages 112 and retard passages 113. An exhaust or vent 119 is in fluid communication with the oil control valve 109 and the vent chamber 133.

A locking mechanism (not shown) may be present to lock the rotor assembly 105 relative to the housing assembly 101. The locking mechanism may be slidably housed in a bore in the rotor assembly 105 and have an end portion assisted towards and fits into a recess in the housing assembly 101 by a spring. Alternatively, the locking mechanism may be housed in the housing assembly 101 and spring assisted towards a recess in the rotor assembly 105.

An oil control valve 109 is in fluid communication with the operating segments 130 through advance passages 112 and retard passages 113 and the assist chamber 134 through the advance passages 112. The oil pressure to the operating segments 130 and the assist chamber 134 of the assist segment 132 is actively controlled by the oil control valve 109. The oil control valve 109 in FIG. 2 is shown to be biased in a first direction by a spring 140 and a second direction by an actuator 142, however any control in which the position of the oil control valve 109 is controlled may be used. The actuator 142 may be an on/off solenoid, variable force solenoid, electromechanical, motor driven, hydraulic, or any other type of actuator.

For example, in a four vane system as shown in FIG. 2, when the phaser is moving towards the advance position, oil pressure flows from supply pump 118, through the oil control valve 109 and through the advance passages 112 to all the advance chambers 102 designated A2, A3, A4 of the operating segments 130 and to the assist chamber 134 of the assist segment 132. At the same time, fluid is exhausting from all the retard chambers 103, designated R2, R3, R4 of the operating segments 130, exhausting fluid through the retard passages 113 and through the oil control valve 109 to exhaust 119. Any fluid that may leak into the vent chamber 133 is immediately exhausted to atmosphere or exhaust 119. The oil pressure in the advance chambers 102, designated A2, A3, A4 move the vanes 104 clockwise in the figure with the oil pressure in the assist chamber 134 assist the movement in the advance direction.

When the phaser is moving towards the retard position, oil pressure flows from supply pump 118, through the oil control valve 109 and through the retard passages 113 to the retard chambers 103, designated R2, R3, and R4, and fluid is exhausted from all of the advance chambers 102 designated A2, A3, A4 through the advance passages 112. At the same time, fluid is exhausted from the vent chamber 133 to atmosphere or exhaust 119 and from the assist chamber 134 through the advance passages 112. The oil pressure in the retard chambers 103, designated R2, R3, R4 move the vanes 104 counterclockwise in the figure.

When the phaser is in a null position, fluid from the supply pump 118 is restricted by the oil control valve 109 to the advance chambers 102, designated A2, A3, A4, the retard chambers 103, designated R2, R3, R4 and the assist chamber 134. Any fluid in the advance chambers 102, the three retard chambers 103, and the assist chamber 134 is blocked from exhausting from the chambers. Any fluid in vent chamber 133 is free to vent to atmosphere or exhaust 119. In an alternate embodiment, fluid from the supply pump 118 may be blocked by the oil control valve 109 from entering the advance chambers 102, designated A2, A3, A4, the retard chambers 103, designated R2, R3, R4 and the assist chamber 134.

By applying supply oil pressure 118 to an increased number of operating segments 130 than assist segments 132, with one of the chambers of the assist segment not being connected to the supply oil pressure 118, a higher torque in the advance direction for any given oil pressure is present causing an assist toward the advance direction, which is desirable to offset friction in the camshaft and valvetrain. Furthermore, by providing a vent chamber 133 within the assist segment 132, the oil pressure actuated phaser has the significant benefits of better balancing of the advance and retard actuation rates, simplifying control strategies; providing much the same function as a bias spring, allowing the elimination of the bias spring, saving cost, weight, and package space; and in the case of a phaser that locks in the advanced direction using a locking mechanism, providing stronger torque to return to the base (locking) position.

Bias springs provide a constant torque offset, regardless of engine operating condition, while in the present invention, a variable torque offset, based on the available oil pressure is provided. This is advantageous because under the engine operating conditions where the camshaft friction torque is high, the oil pressure also tends to be high (such as cold temperature), the present invention gives a more consistent phaser response than conventional bias springs. The use of oil pressure assist also eliminates the phase angle sensitivity of mechanical bias springs, such as spring torque changes with phase angle, which is undesirable.

Figure 3:
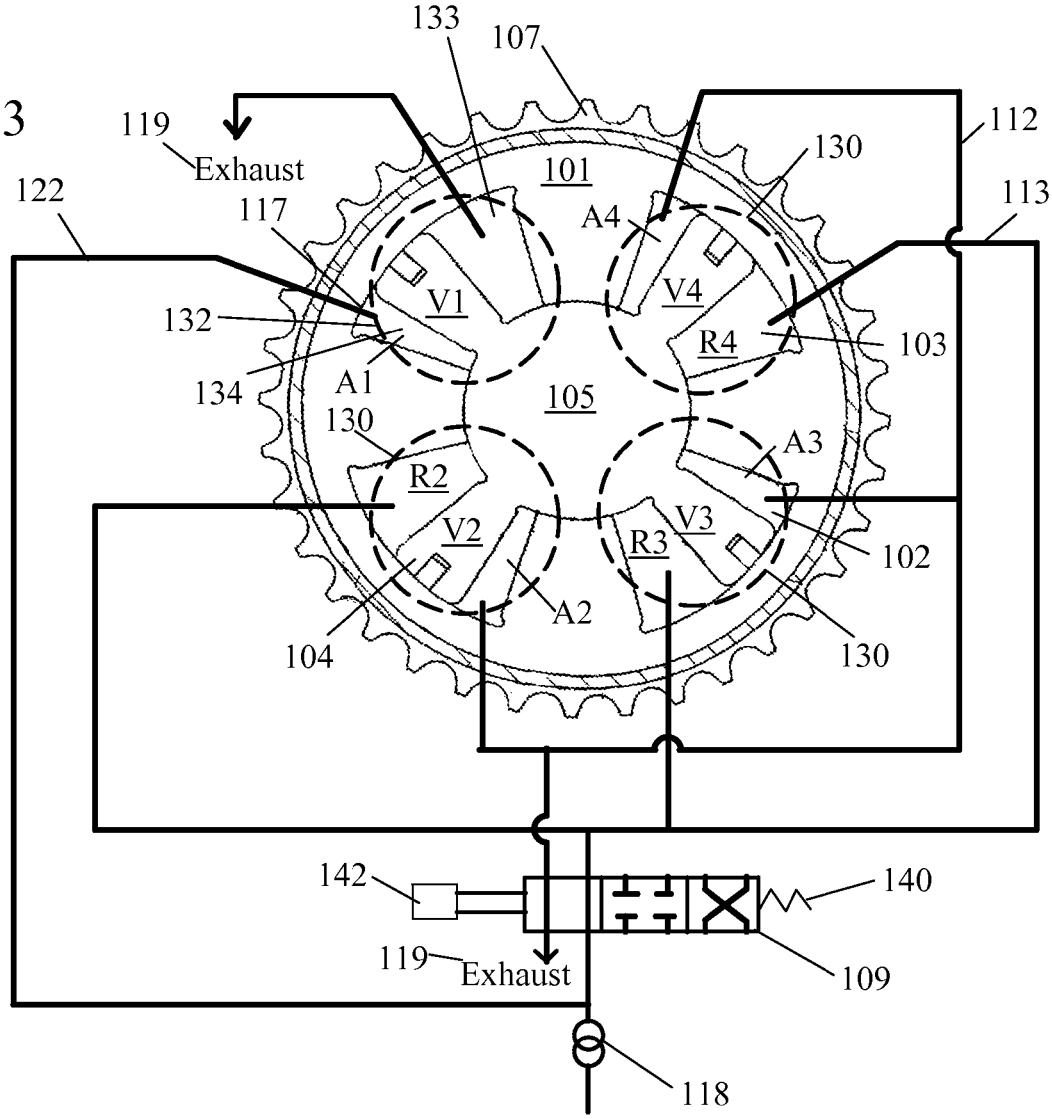
FIG. 3 shows a schematic of a phaser of a second embodiment of the present invention.

FIG. 3 shows an illustrative example of a second embodiment of the present invention. In this embodiment, an assist towards an advance direction is passively controlled. As in the previous embodiment, the phaser has at least one assist segment 132 and one or more operating segments 130. In one embodiment, the phaser preferably has a greater number of operating segments 130 than assist segments 132.

The housing assembly 101 of the phaser has an outer circumference 107 for accepting drive force. The rotor assembly 105 is connected to a shaft (not shown) and is coaxially located within the housing assembly 100. The operating segments 130 are each defined by the chamber 117 formed between the housing assembly 101 and the rotor assembly 105 and separated into advance fluid chambers 102, designated as A2, A3, A4 and retard fluid chambers 103 designated as R2, R3, R4 by a vane 104 designated V2, V2, V4. The one or more vanes 104, designated V2, V2, V4 are capable of rotation to bi-directionally shift the relative angular position of the housing assembly 101 and the rotor assembly 105 within the operating segments 130 of the phaser.

The assist segment 132 is defined by the chamber 117 formed between the housing assembly 101 and the rotor assembly 105 and a vane 104 separating the chamber into a fluid assist chamber 134 in fluid communication with an oil pressure supply pump 118 that supplies a constant feed of oil pressure and a vent chamber 133 vented to atmosphere or exhaust 119 at all times. The vane 104, designated V1 is capable of rotation to uni-directionally shift the relative angular position of the housing assembly 101 and the rotor assembly 105 and therefore, the assist segment 132 assists in shifting the relative angular position of the housing assembly relative to the rotor assembly in one direction only. While the figures only show the assist toward advancing the phaser, a person skilled in the art may apply the invention such that the assist would be toward retarding the phaser. It should be noted that while the supply pump 118 is shown as providing the supply oil pressure to the assist chamber 134, a separate pump may also provide the supply oil pressure.

A locking mechanism (not shown) may be present to lock the rotor assembly 105 relative to the housing assembly 101. The locking mechanism may be slidably housed in a bore in the rotor assembly 105 and have an end portion assisted towards and fits into a recess in the housing assembly 101 by a spring. Alternatively, the locking mechanism may be housed in the housing assembly 101 and spring biased towards a recess in the rotor assembly 105.

An oil control valve 109 is in fluid communication with the operating segments 130 through advance passages 112 and retard passages 113. The oil pressure to the operating segments 130 is actively controlled by the oil control valve 109. The oil control valve 109 in FIG. 3 is shown to be biased in a first direction by a spring 140 and a second direction by an actuator 142, however any control in which the position of the oil control valve 109 is controlled may be used. The actuator 142 may an on/off solenoid, variable force solenoid, electromechanical, motor driven, hydraulic, or any other type of actuator. It should be noted that in this embodiment, the oil control valve 109 does not control the fluid to the assist chamber 134 of the assist segment 132.

For example, in a four vane system as shown in FIG. 3, when the phaser is moving towards the advance position, oil pressure flows from supply pump 118, through the oil control valve 109 and through the advance passages 112 to all the advance chambers 102 designated A2, A3, A4 of the operating segments 130. Fluid is also constantly being supplied to the assist chamber 134 of the assist segment 132 by a supply pump 118. At the same time, fluid is exhausting from all the retard chambers 103, designated R2, R3, R4 of the operating segments 130, exhausting fluid through the retard passages 113 and through the oil control valve 109 to exhaust 119. Any fluid that may leak into the vent chamber 133 is immediately exhausted to atmosphere or exhaust 119. The oil pressure in the advance chambers 102, designated A2, A3, A4 move the vanes 104 clockwise in the figure with the oil pressure in the assist chamber 134 assist the movement in the advance direction.

When the phaser is moving towards the retard position, oil pressure flows from supply pump 118, through the oil control valve 109 and through the retard passages 113 to the retard chambers 103, designated R2, R3, and R4, and fluid is exhausted from all of the advance chambers 102 designated A2, A3, A4 through the advance passages 112. At the same time, fluid is exhausted from the vent chamber 133 to atmosphere or exhaust 119. Fluid is also being constantly supplied to the assist chamber 134 by the supply pump 118. The oil pressure in the retard chambers 103, designated R2, R3, R4 move the vanes 104 counterclockwise in the figure.

When the phaser is in a null position, fluid from the supply pump 118 is restricted by the oil control valve 109 to the advance chambers 102, designated A2, A3, A4, the retard chambers 103, designated R2, R3, R4. Fluid is constantly being supplied to the assist chamber 134 from the supply pump 118 unrestricted. Any fluid in the advance chambers 102, the three retard chambers 103 is blocked from exhausting from the chambers. Any fluid that may leak into the vent chamber 133 is immediately vented to atmosphere or exhaust 119. In an alternate embodiment, fluid from the supply pump 118 may be blocked by the oil control valve 109 from entering the advance chambers 102, designated A2, A3, A4, and the retard chambers 103, designated R2, R3, R4.

By applying supply oil pressure 118 to an increased number of operating segments 130 than assist segments 132, with one of the chambers of the assist segment not being connected to the supply oil pressure 118, a higher torque in the advance direction for any given oil pressure is present causing an assist toward the advance direction, which is desirable to offset friction in the camshaft and valvetrain. Furthermore, by providing a vent chamber 133 within the assist segment 132, the oil pressure actuated phaser has the significant benefits of better balancing of the advance and retard actuation rates, simplifying control strategies; providing much the same function as a bias spring, allowing the elimination of the bias spring, saving cost, weight, and package space; and in the case of a phaser that locks in the advanced direction using a locking mechanism, providing stronger torque to return to the base (locking) position.

Bias springs provide a constant torque offset, regardless of engine operating condition, while in the present invention, a variable torque offset, based on the available oil pressure is provided. This is advantageous because under the engine operating conditions where the camshaft friction torque is high, the oil pressure also tends to be high (such as cold temperature), the present invention gives a more consistent phaser response than conventional bias springs. The use of oil pressure assist also eliminates the phase angle sensitivity of mechanical bias springs, such as spring torque changes with phase angle, which is undesirable.

An advantage of the passive assist system over the active assist system is that less oil flows through the oil control valve at the same actuation and the oil does not have to flow through the oil control valve and restrictions, overall resulting in an increasingly responsive system.

In the above embodiments and examples, the vent chamber corresponding to being a retard chamber was always vented to atmosphere to cause an assist of the phaser in the advance direction, however a person skilled in the art may apply the vent chamber to an advance chamber and vent the advance chamber to atmosphere to cause a assist of the phaser in the retard direction.

In any of the above embodiments, the oil control valve may be located within the phaser or remotely from the phaser.

The number of segments, vanes, and corresponding advance and retard chambers are provided as illustrative examples only and does not limit the number of vanes or chambers that may be present within the phaser.

While all embodiments are shown without an inlet check valve, and therefore are oil pressure actuated phasers, a person skilled in the art would be able to apply all of the above embodiments to a torsional assist phaser in which a check valve is present.

In all of the above embodiments, it is understood that the oil control valve has an infinite number of intermediate positions, so that the control valve not only controls the direction the VCT phaser moves but, depending on the discrete spool position, controls the rate at which the VCT phaser changes positions. Therefore, it is understood that the oil control valve can also operate in infinite intermediate positions and is not limited to the positions shown in the Figures.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for adjusting phase between a first shaft and a second shaft using oil pressure from an oil pressure source, comprising:

a housing assembly having an outer circumference to accept a drive force; and a rotor assembly having a plurality of vanes coaxially located within the housing assembly for connection to the first shaft, the housing assembly and the rotor assembly defining a plurality of segments, each segment divided into two chambers by one of the plurality of vanes, the plurality of segments comprising:

at least one operating segment comprising an advance chamber and a retard chamber, the advance chamber and the retard chamber being oppositely switchable between at least a source of oil pressure and a drain, the vane being movable by oil pressure from the oil source applied to either the advance chamber or the retard chamber with the other of the advance chamber and the retard chamber being coupled to the drain, the moving of the vane acting to shift the relative angular phase of the rotor assembly and the housing assembly; and at least one assist segment comprising an assist chamber and a vent chamber, the vent chamber being vented to atmosphere; such that oil supplied to the assist chamber assists the motion of the vane in a direction.

2. The phaser of claim 1, wherein oil pressure supplied to the assist chamber of the at least one assist segment is controlled through an oil control valve.

3. The phaser of claim 1, wherein oil pressure supplied to the assist chamber of the at least one assist segment is supplied directly from the source of oil pressure.

4. The phaser of claim 1, wherein the phaser comprises more operating segments than assist segments.

5. The phaser of claim 1, wherein the direction of motion of the vane in the at least one assist segment resulting from the supply of oil to the assist chamber of the assist segment is an advancing direction.

6. The phaser of claim 1, wherein the direction of motion of the vane in the at least one assist segment resulting from the supply of oil to the assist chamber of the assist segment is a retard direction.

* * * * *